US006531651B2

(12) United States Patent
Kanemitsu et al.

(10) Patent No.: US 6,531,651 B2
(45) Date of Patent: Mar. 11, 2003

(54) KEY FOR MUSICAL INSTRUMENT

(75) Inventors: Makoto Kanemitsu, Shizuoka-ken (JP); Mitsuo Yamashita, Shizuoka-ken (JP); Hiroyuki Kurita, Shizuoka-ken (JP); Masahiko Abiko, Shizuoka-ken (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/846,195

(22) Filed: May 2, 2001

(65) Prior Publication Data

US 2001/0027712 A1 Oct. 11, 2001

Related U.S. Application Data

(60) Provisional application No. 60/247,032, filed on Nov. 13, 2000.

(30) Foreign Application Priority Data

| | | |
|---|---|---|
| Nov. 11, 1999 | (JP) | 11-320927 |
| Nov. 18, 1999 | (JP) | 11-328655 |
| Nov. 18, 1999 | (JP) | 11-328656 |
| Nov. 25, 1999 | (JP) | 11-334648 |
| Dec. 7, 1999 | (JP) | 11-348087 |
| Jan. 6, 2000 | (JP) | 2000-000799 |

(51) Int. Cl.[7] ..... G10C 3/12

(52) U.S. Cl. ..... 84/433; 84/438; 84/439; 84/440; 84/452 P; 84/452 R

(58) Field of Search ..... 84/433, 438, 439, 84/440, 452 P, 452 R

(56) References Cited

U.S. PATENT DOCUMENTS

| | | | | | |
|---|---|---|---|---|---|
| 633,915 | A | * | 9/1899 | Smith | 84/436 |
| 5,796,024 | A | * | 8/1998 | Stanwood | 84/433 |
| 6,096,959 | A | * | 8/2000 | Davide | 84/433 |
| 6,191,351 | B1 | * | 2/2001 | Niitsuma | 84/720 |

FOREIGN PATENT DOCUMENTS

| | | | |
|---|---|---|---|
| JP | 11-184457 | | 7/1999 |
| JP | 11-212543 | | 8/1999 |
| JP | 184055 | * | 7/2001 |

* cited by examiner

*Primary Examiner*—Shih-Yung Hsieh
(74) *Attorney, Agent, or Firm*—Crowell & Moring LLP

(57) ABSTRACT

A key is provided for permitting simple attachment of a weight and easy adjustment of a touch load, while using an alternative material for substitution for lead as a material for the weight, to thereby reduce the manufacturing cost. A swingable key body is formed with an embedding hole. The weight is made of a composite material produced by blending a plurality of kinds of materials except for lead in a predetermined blending proportion to have a predetermined specific gravity, and is removably attached to the embedding hole of the key body.

25 Claims, 16 Drawing Sheets

KEY FOR MUSICAL INSTRUMENT

This application claims the benefit of Provisional Application No. 60/247,032 filed Nov. 13, 2000.

BACKGROUND OF THE INVENTION

1. Field of the Invention

The present invention relates to a key for use in a piano and so on, and more particularly, to a key which has a weight attached thereto to provide a desired touch load.

2. Prior Art

FIG. 1 illustrates a conventional key (white key) for a grand piano. This key 51 is comprised of an elongated key body 52 made of wood and having a rectangular cross section; a white key cover 53 made of plastic covering a front region of the key body; a plurality (three in this example) of weights 54 attached on a side face of the key body 52; and so on. The key body 52 is swingably supported by a balance pin (not show) at the center thereof, and an action (not shown) is carried thereon in a region behind the balance pin. FIG. 2 illustrates a conventional black key, the configuration of which is basically identical to that of the white key. A sharp key cover 58, which is made of plastic, is formed with a recess open to below, and is adhered to a front region of the top face of the key body 52 to cover the same.

The weights 54 are attached to provide a desired touch load (static load) for the key, and are each made of lead of a predetermined size molded into a cylindrical shape. On the other hand, the key body 52 is formed with three circular embedding holes 55 of a predetermined size which laterally extend through the key body 52 at predetermined positions in a front region thereof. The weights 54 are filled in these embedding holes 55, and then caulked for attachment to the key body 52. The lead is employed as the weights 54 in this manner because the lead has a high specific gravity (approximately 11.3) among metals, is inexpensive, and exhibits high flexibility and ductility which facilitate works as mentioned above.

Generally, the touch load may be adjusted after the weights 54 have been attached as described above for purposes of eliminating variations in touch load among keys and of matching the touch load for a player's preference. For adjusting the touch load, a side face of a weight 54 is cut away for reducing the touch load since the weight 54 is attached by caulking and therefore removed with difficulties. On the other hand, for increasing the touch load, at least one of previously provided separate adjusting weight 56, made of lead, is additionally attached to the key body 52, as indicated by broken lines in FIG. 1, for the same reason. In this event, a position for attaching the adjusting weight 56 is first determined such that the moment imparted by the adjusting weight 56 about the balance pin is appropriately produced in accordance with the touch load to be added. Then, an embedding hole 57 is additionally formed at the determined attaching position on the key body 52, followed by caulking the adjusting weight 56 for attachment. These works are performed for each key 51.

In the conventional key 51 described above, lead is used as the material for the weights 54 for the reasons mentioned above. However, since lead is an injurious material, it is desirable that lead is used for the weights of the keys as least frequently as possible, so that an alternative material is needed for substitution for lead. Also, since the conventional key 51 involves caulking for attaching the weights 54 to each key body 52, this work itself is laborious. Also, due to difficulties in removal of the weights 54 attached by caulking, and due to the constant specific gravity of the weights 54, the adjustment of the touch load involves the works which include cutting away the side face of a weight 54, forming an embedding hole 57 into the key body 52 while determining a position at which an adjusting weight 56 is attached, and attaching the adjusting weight 56 for each key 51, as described above. As a result, the adjusting works require significant efforts, resulting in an increase in the manufacturing cost. Further, the attachment of the adjusting weight 56 requires the formation of the embedding hole 57 laterally extending through the key body 52, in addition to the original embedding holes 55, thereby giving rise to a problem that the strength of the key body 52 tends to be insufficient.

SUMMARY OF THE INVENTION

It is an object of the present invention to solve the problems as mentioned, and specifically to provide a key which is capable of facilitating the attachment of a weight, and adjustments of a touch load, while using an alternative material for substitution for lead as a material for the weight, thereby reducing the manufacturing cost.

To achieve this object, a key according to a first invention is characterized by comprising a swingable key body formed with an embedding hole; and a weight made of a composite material produced by blending a plurality of kinds of materials except for lead in a predetermined blending proportion so as to have a predetermined specific gravity, and removably attached to the embedding hole of the key body.

According to this key, the weight is made of a composite material produced by mutually blending a plurality of kinds of materials except for lead in a predetermined blending proportion, and removably attached to the embedding hole formed in the key body to add a weight to the key body. In this case, the specific gravity of the entire composite material thus blended can be made equivalent to that of lead by using, for example, a suitable high specific gravity metal as one of the materials except for lead. Therefore, the composite material thus composed can be used as an alternative material for the weight for substitution for conventionally used lead. Also, since the weight made of the composite material can be removably attached to the embedding hole, the attachment and removal of the weight can be readily carried out as compared with the conventional one which is caulked for attachment.

In this case, preferably, one of the plurality of kinds of materials comprises an elastic material, so that the weight has elasticity, and is removably attached to the embedding hole of the key body through press fitting.

In this configuration, the weight made to have elasticity given by one of the materials comprising an elastic material can be attached to the embedding hole through simple press fitting, so that the attachment and removal of the weight become more easy than the conventional caulked one, thereby making it possible to reduce the manufacturing cost by simplifying the works involved in attaching the weight.

In this case, preferably, the elastic material comprises rubber, and another one of the plurality of kinds of materials comprises powdered tungsten.

Tungsten is harmless and has a very large specific gravity (approximately 19.3), so that it is particularly suitable for achieving a specific gravity in a required range which includes a specific gravity equivalent to lead, with a blend of rubber. Also, since the rubber, which comprises an elastic material, serves to ensure the elasticity of the weight, and is relatively inexpensive, the material cost can be reduced correspondingly.

In these cases, preferably, the weight comprises a plurality of types of weights made by blending the elastic material and the other one of the plurality of kinds of material in different blending proportions from one another to have different specific gravities from one another.

In this configuration, since the weight comprises a plurality of types of weights having different specific gravities, the weight can be made different without changing the size thereof. Therefore, for example, the touch load can be readily adjusted by previously providing a plurality of weights having the same shape and size as one another and different weights, and selecting one having an appropriate weight from these weights for attachment to the embedding hole. This results in complete elimination of the cutting of the weight for reducing the touch load, and the additional provision and positioning of an embedding hole and a weight for adjustment for increasing the touch load in the prior art. The key manufacturing cost can be further reduced correspondingly by the omission of such laborious works for adjusting the touch load. Also, since no embedding hole for adjusting the touch load need be additionally formed, it is possible to prevent a degraded strength of the key body which would otherwise result therefrom.

In this case, preferably, the key body comprises a plurality of key bodies which are formed with the embedding holes of a shape and a size identical to one another, respectively, wherein the plurality of types of weights have the shape and size identical to one another, so that they can be removably press fitted into the embedding holes.

In this configuration, weights having optimal weights, selected from the plurality of weights, can be attached to the embedding holes previously formed in the plurality of key bodies to have the same shape and size. Therefore, unlike the prior art, the touch load can be more readily adjusted, resulting from the fact that the position and size of the embedding hole need not be determined for each key.

Alternatively, it is preferable that the key further comprises a weight attaching member made of an elastic material in the shape of a sleeve having an inserting hole, wherein the weight is fitted into the inserting hole of the weight attaching member, and removably fitted into the embedding hole of the key body through the weight attaching member.

In this configuration, the weight is fitted into the inserting hole in the sleeve-shaped weight attaching member made of an elastic material, and is removably fitted into the embedding hole of the key body, taking advantage of the elasticity of the weight attaching member. In this way, the weight can be readily attached to the embedding hole of the key body through simple press fitting, so that the attachment and removal of the weight is made easier than the conventional caulked one to simplify the works involved in the attachment of the weight, thereby making it possible to reduce the manufacturing cost.

In this case, preferably, the plurality of kinds of materials include powdered tungsten and plastic, and the elastic material comprises rubber.

This configuration provides the advantage of tungsten which is harmless and has a very high specific gravity. Also, the rubber, which comprises an elastic material, serves to ensure the elasticity for removably fitting the weight attaching member and the weight, and is relatively inexpensive, thereby making it possible to reduce the material cost correspondingly.

In these cases, preferably, the weight comprises a plurality of types of weights which are made of a composite material produced by blending the plurality of kinds of materials except for lead in different blending proportions from one another so as to have different specific gravities from one another, and have a size and a shape identical to one another.

In this configuration, the plurality of types of weights have the size and shape identical to one another, and differ from one another in the blending proportion of the plurality of kinds of materials, of which they are made, to have different specific gravities and hence weights from one another. It is therefore possible to readily adjust the touch load by selecting one having an optimal weight from the plurality of types of weights.

Also, to achieve the aforementioned object, a key according to a second invention is characterized by comprising a swingable key body formed with an embedding hole; and a weight fitted in the embedding hole of the key body, wherein the weight has a weight attaching member made of heat shrinkable plastic in the shape of a sleeve having a predetermined size, and a weight body made of a predetermined metal material except for lead in the shape of a cylinder having a predetermined size, accommodated in the thermally shrunk weight attaching member in close contact therewith.

According to this key, the weight has a weight attaching member made of heat shrinkable plastic in the shape of sleeve and a weight body made of a predetermined metal material except for lead in a cylindrical shape. After the weight body is inserted into the weight attaching member, the weight attaching member is heated for shrinkage to bring the weight attaching member into close contact with the weight body, with the result that the weight is assembled with the weight body contained therein. Then, the assembled weight is inserted into the embedding hole formed in the key body for attachment thereto. In this case, the material in the foregoing composition can be used as an alternative material for substitution for lead by selecting a proper one having a high specific gravity as the metal material except for lead. Also, a noise reduction function, possessed by conventionally used lead itself, may be provided by selecting a heat shrinkable plastic which can absorb sound in a certain frequency range as the heat shrinkable plastic, of which the weight attaching member is made.

In this case, preferably, the heat shrinkable plastic has elasticity.

In this configuration, when the weight is fitted into the embedding hole of the key body, the weight can be readily attached while deforming the elastic weight attaching member through shrinkage. Also, after the attachment, the elastic return force of the weight attaching member keeps the weight in close contact with the embedding hole, thereby making it possible to prevent trembling of the weight and noise resulting therefrom.

Further, to achieve the aforementioned object, a key according to a third invention is characterized by comprising a swingable key body formed with an embedding hole; and a weight made of a molded composite material produced by blending a metal except for lead and plastic in a predetermined blending proportion to have a predetermined specific gravity, and embedded in the embedding hole to be attached to the key body, wherein the embedding hole is formed in a circular hole, and the weight is formed in the shape of a cylinder which can be press fitted into the embedding hole, and has a convex element on the outer peripheral face thereof to reduce a frictional resistance when the weight is press fitted into the embedding hole.

According to this key, the weight is made of a molded composite material produced by blending a metal except for lead and plastic in a predetermined blending proportion, and embedded in the embedding hole for attachment to the key body. In this case, the composite material in the foregoing composition can be used as an alternative material for substitution for lead by selecting a proper one having a high specific gravity as the metal material except for lead. Generally, a composite material produced by blending a metal and plastic has characteristics that it is not so ductile as lead, and is vulnerable to an impact. Therefore, as in the present invention, the convex element formed on the outer peripheral face of the weight facilitates the press fitting of the weight into the embedding hole by alleviating a frictional resistance when the weight is press fitted into the embedding hole. In addition, even when the weight is attached by caulking or the like, an impact at that time is reduced so that the weight can be made less susceptible to a failure and so on.

In this case, preferably, the metal except for lead comprises powdered tungsten, and the plastic comprises nylon.

This configuration provides the advantage of tungsten which is harmless and has a very large specific gravity. Also, nylon is relatively tough and highly impact resistant among plastic. Therefore, by employing nylon as a base resin, it is possible to ensure such characteristics that are required for the weight. Also, since nylon is apt to injection molding, the weight can be readily molded into a desired shape.

Also, preferably, the weight comprises a plurality of types of weights made of a plurality of kinds of composite materials having different specific gravities from one another, produced by blending the metal except for lead and the plastic in different blending proportions from one another.

In this configuration, since the weight comprises a plurality of types of weights having different specific gravities, a different weight can be provided without changing their sizes. It is therefore possible to readily adjust the touch load by selecting one having an optimal weight from the plurality of types of weights.

Also, preferably, the convex element comprises a plurality of protrusions formed on the outer peripheral face of the weight and spaced apart from one another.

In this configuration, the plurality of protrusions formed as the convex element on the outer peripheral face of the weight can alleviate the frictional resistance when the weight is press fitted into the embedding hole, and provide the resulting effects mentioned above. Particularly, since the caulking effect can be ensured, the weight can be securely attached to the key body.

In the alternative, the convex element preferably comprises two flanges formed on both ends of the outer peripheral face of the weight along the circumferential direction.

According to this configuration, the two flanges formed as the convex element on both ends of the outer peripheral face of the weight can alleviate the frictional resistance when the weight is press fitted into the embedding hole, and provide the resulting effects mentioned above. Particularly, since the caulking effect can be ensured, the weight can be securely attached to the key body.

Further alternatively, the convex element preferably comprises a plurality of elastic protrusive pieces arranged on both ends of the outer peripheral face of the weight and spaced apart from each other in the circumferential direction, wherein the elastic protrusive pieces extend outward in the axial direction, and stuck out in a radial direction.

In this configuration, the plurality of elastic protrusive pieces formed as the convex element can alleviate the frictional resistance when the weight is press fitted into the embedding hole. Also, the weight can be snap fitted into the embedding hole, taking advantage of the elasticity of the protrusive pieces, so that the weight can be securely attached to the key body without caulking.

Further alternatively, the convex element preferably comprises a plurality of circumferentially extending larger diameter portions arranged at positions except for both ends of the outer peripheral face of the weight, and spaced apart in the axial direction.

In this configuration, the plurality of larger diameter portions as mentioned, formed as the convex element, can alleviate the frictional resistance when the weight is press fitted into the embedding hole. Also, since the plurality of larger diameter portions are positioned in a central region of the outer peripheral face of the weight, the caulking effect can be further enhanced, thereby making the weight less susceptible to a failure and so on due to an impact, as compared with the aforementioned weight which has the flanges formed on both ends.

Further alternatively, the convex element preferably comprises a large number of axially extending convex bars arranged on the outer peripheral face of the weight, and spaced apart in the circumferential direction.

In this configuration, the large number of convex bars as mentioned above, formed as the convex element, can alleviate the frictional resistance when the weight is press fitted into the embedding hole. Also, since the large number of convex bars are disposed in the circumferential direction and extend in the axial direction to make the weight prone to shrinkage and deformation, the caulking and so on are facilitated, and an impact is reduced during the caulking, thereby making the weight less susceptible to a failure.

Further, to achieve the aforementioned object, a key according to a fourth invention is characterized by comprising a swingable key body having a rectangular cross section, extending in the longitudinal direction, and formed with a recess in a front region of the top face thereof and along the same; a plate-shaped weight made of a composite material produced by blending a plurality of kinds of materials except for lead having different specific gravities from one another, accommodated in the recess of the key body to impart a weight to the key body; and a key cover attached on the front region of the key body so as to cover the weight.

According to this key, the weight is formed in the shape of plate from a composite material produced by blending a plurality of kinds of materials except for lead having different specific gravities, and is accommodated in the recess formed along the front region of the top face of the key body. In this case, for example, by using a proper metal having a high specific gravity as one material except for lead and using plastic as another material, the specific gravity of the whole blended composite material can be a large specific gravity equivalent or approximate to that of lead. Also, the weight, in a plate shape, can be disposed in the longitudinal direction along the recess of the key body. It is therefore possible to sufficiently ensure the weight of the weight, so that the composite material in the above composition can be used as an alternative material for substitution for conventionally used lead.

Also, unlike the prior art, the weight is attached to the key body by accommodating it in the recess formed in the top face thereof to eliminate a work for forming an embedding hole for attaching the weight, and a work for caulking the weight, so that the manufacturing cost can be reduced as a result of the simplification of the attaching works. Since the attached weight is covered with the key cover, the outer appearance of the key will not be affected at all.

In this case, preferably, the key body is formed with an embedding hole on a side face of the key body at a longitudinal position determined in accordance with a touch load given by the weight, and the key further comprises a weight for adjustment embedded in the embedding hole for adjusting the touch load.

According to this configuration, a longitudinal position of the key body is determined in accordance with a touch load provided in a state in which the plate-shaped weight is attached, and an embedding hole is formed on the side face of the key body at the determined position. Then, a weight for adjustment having a predetermined weight is fitted to adjust the touch load. Since the weight for adjustment is also made of a material except for lead, the weight for the key, together with the plate-shaped weight, can be made without using any lead.

Also, since the weight is disposed only near the top face of the key body and does not exist in a lower portion, the weight for adjustment can be attached at a determined desired attaching position, without being interfered by an existing weight, unlike the prior art. As a result, the touch load can be efficiently adjusted without changing the weight or attaching position of the weight for adjustment.

Further, for example, the touch load can be readily adjusted only with a single weight for adjustment by setting the plate-shaped weight to such a weight as to burden a majority of a weight which should be given to the key body. Also, in this case, since only one embedding hole need be formed, a degraded strength of the key body, caused by the formation of the embedding hole, can be limited to a minimum.

Alternatively, the weight preferably comprises a plurality of types of weights having different weights from one another.

In this configuration, the touch load can be readily adjusted only with the plate-shaped weight by selecting a single weight having an optimal weight from the plurality of types of weights having different weights. Also, since no embedding hole is required, the strength of the key body can be sufficiently maintained.

In this case, preferably, the plurality of types of weights are respectively made of composite materials having different specific gravities from one another, produced by blending the plurality of kinds of materials in different blending proportions from one another, and have a size and a shape identical to one another complementary to the recess of the key body.

In this configuration, it is possible to readily provide a plurality of types of weights which are identical in size and shape and different in weight due to the difference in specific gravity. Also, since the weight is formed complementarily to the recess of the key body, any weight can be exactly fitted into the recess, thereby making it possible to attach the weight to the key body without trembling.

Further, to achieve the aforementioned object, a key according to a fifth embodiment is characterized by comprising a swingable key body; a sharp key cover having a cavity open to below, and attached on the top face of the key body; and a weight made of a composite material produced by blending a plurality of kinds of materials except for lead having different specific gravities from one another, and accommodated in the cavity of the sharp key cover to impart a weight to the key body.

According to this key, the weight is made of a composite material produced by blending a plurality of kinds of materials except for lead, and is accommodated in the cavity of the sharp key cover. In this case, for example, by using a proper metal having a high specific gravity as one material except for lead and using plastic as another material, the specific gravity of the whole blended composite material can be equivalent to that of lead, or lie in a predetermined range including the specific gravity equivalent to that of lead. It is therefore possible to use the composite material in the above composition as an alternative material for substitution for conventionally used lead.

Also, since the weight is accommodated in the cavity of the sharp key cover for attachment, thus eliminating the conventional work for forming an embedding hole and work for caulking the weight, the manufacturing cost can be reduced correspondingly by a reduction in the number of steps for these works. As mentioned above, the sharp key cover is generally formed with a cavity, and such a cavity is utilized as it is for accommodating the weight, so that any change in the design of the sharp key cover is not required, and any increase in cost does not arise therefor. Also, the absence of the embedding hole formed in the key body can maintain the strength of the key body.

In this case, preferably, the weight is molded into a predetermined size and shape corresponding to the cavity of the sharp key cover, and fitted in the cavity.

In this configuration, since the weight is exactly fitted in the cavity of the sharp key cover and attached in this state, the weight can be prevented from trembling in the sharp key cover when the black key swings, so that a smooth operation of the black key can be ensured.

In these cases, preferably, the weight comprises a plurality of types of weights having different weights from one another.

In this configuration, the touch load can be readily adjusted by selecting a single weight having a required weight from the plurality of types of weights having different weights. This result in complete elimination of the cutting of the weight, and the additional provision and positioning of an embedding hole and a weight for adjustment for increasing the touch load in the prior art. The black key manufacturing cost can be further reduced correspondingly by the omission of such laborious works for adjusting the touch load.

In this case, preferably, the plurality of types of weights are respectively made of composite materials having different specific gravities from one another, produced by blending the plurality of kinds of materials in different blending proportions from one another.

In this configuration, it is possible to readily provide, for example, a plurality of types of weights which are identical in size and shape and different in weight due to the difference in specific gravity. Therefore, the touch load can be smoothly adjusted since the attachment of the weight to the recess of the sharp key cover can be performed in a similar manner with any of the plurality of types of weights.

Alternatively, the plurality of types of weights preferably have different sizes from one another.

In this configuration, a plurality of types of weights having different weights can be readily provided, for example, by only changing the size (for example, the length) without changing the specific gravity of the composite material, so that the touch load can be smoothly adjusted.

DESCRIPTION OF THE EMBODIMENTS

Figure 1:
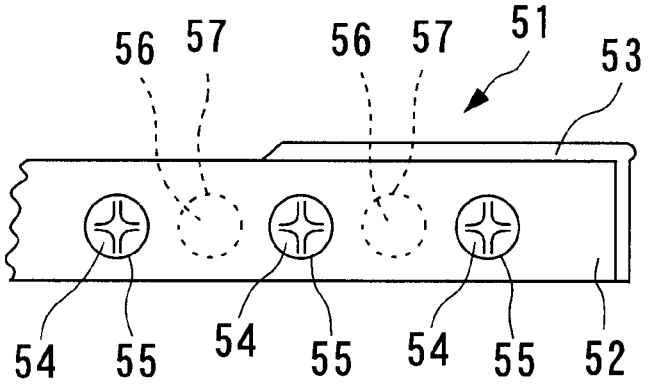
FIG. 1 PRIOR ART
FIG. 1 is a partial side view illustrating a front region of a conventional key (white key)
Figure 2:
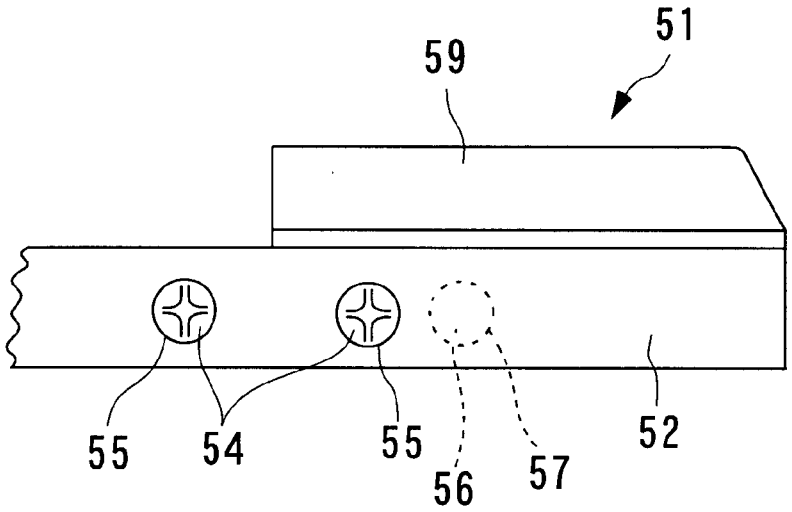
FIG. 2 PRIOR ART
FIG. 2 is a partial side view illustrating a front region of a conventional key (black key)
Figure 3:
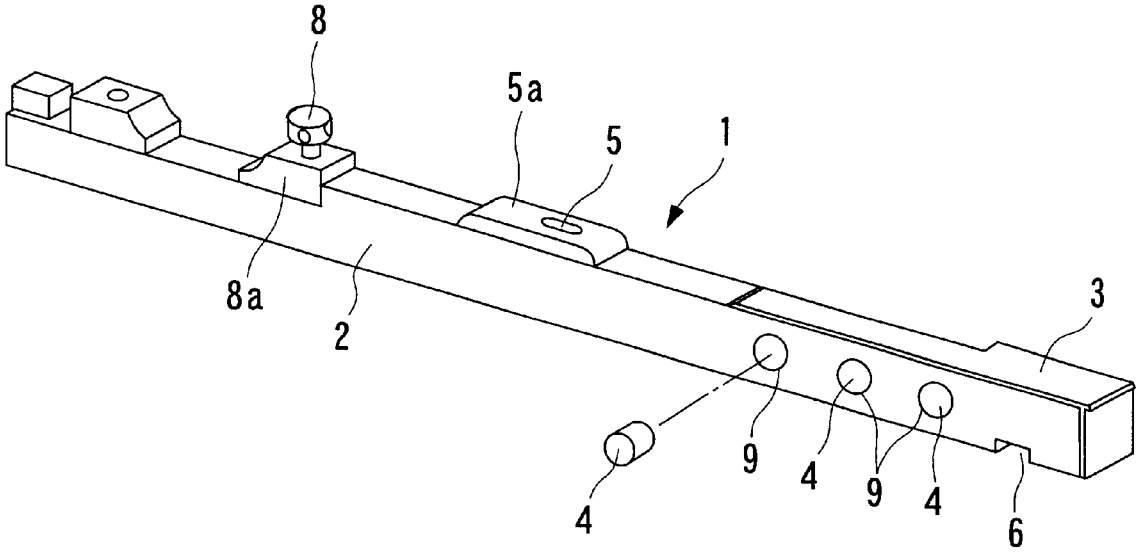
FIG. 3 is a perspective view illustrating a key (white key) for a grand piano according to a first embodiment of the present invention.

Preferred embodiments of the present invention will hereinafter be described with reference to the drawings. FIG. 3 illustrates a key (white key) for a grand piano according to a first embodiment of the present invention. As illustrated in the figure, this key 1 is comprised of a key body 2; a white key cover 3 attached to a front region of the key body; a plurality of weights 4 attached to the front region of the key body 2; and so on.

The key body 2 is made of a wood material such as spruce, pine or the like which is relatively light in weight, viscous and highly elastic, and has a rectangular cross section extending in the longitudinal direction. The white key cover 3 is formed of acrylic or the like in an L-shape, and is adhered on a front half of the top face and a front face of the key body 2 to cover these areas. A middle plate 5*a* is adhered in a central region on the top of the key body 2, and a balance pin hole 5 is formed through them in the vertical direction. This balance pin hole 5 is engaged with an upright balance pin (not shown) to swingably support the key 1. The key body 2 is also formed with a front pin hole 6 in a front edge region of the bottom face thereof. This front pin hole 6 is engaged with an upright front pin (not shown) to prevent horizontal deflection of the key 1.

A capstan screw 8 is further attached to a position behind the balance pin hole 5 on the top face of the key body 2 through a capstan plate 8*a*. An action (not shown) is carried on this capstan screw 8. With the foregoing configuration, when a front portion of the key 1 is pressed, the key 1 swings about the balance pin, causing the capstan screw 8 to push up the action for its actuation. A touch load of the key 1 is determined by the balance of a moment produced by the weight of the action and the key 1 about the balance pin.

The key body 2 is also formed with three embedding holes 9, and weights 4 are attached to these embedding holes 9, respectively. These embedding holes 9, which are formed at predetermined positions on the front side from the balance pin hole 5 of the key body 2 in a line in the longitudinal direction, have a circular cross section and the same predetermined diameter, and are formed extending from one side to the other.

Figure 24:
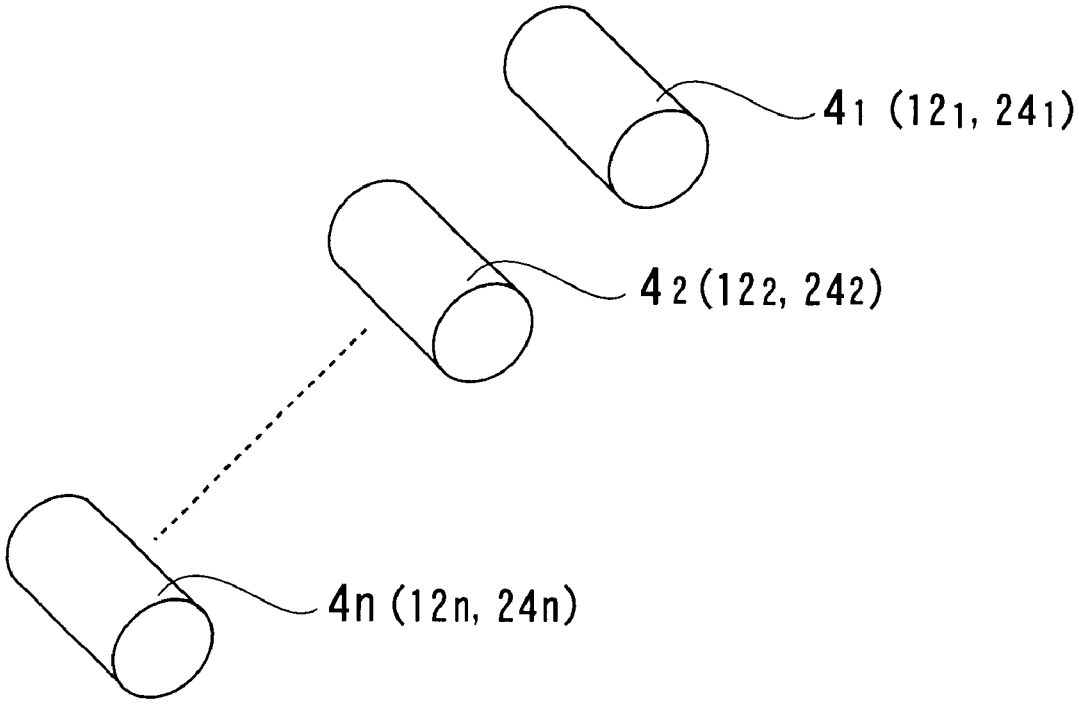
FIG. 24 is a perspective view illustrating various types of weights in the first, second and fourth embodiments which have different weights from one another.

The weight 4, on the other hand, is in the shape of a cylinder having a predetermined diameter and length, and is made of an elastic composite material produced by blending a material other than lead, for example, tungsten and an elastic material, for example, rubber. Taking advantage of its elasticity, the weight 4 is press fitted into the embedding hole 9 for removable attachment to the key body 2. Also, as illustrated in FIG. 24, various types of weights 4*l*–4*n* have been previously provided as the weight 4. These various types of weights 4*l*–4*n* have different predetermined specific gravities from one another, and hence different predetermined weights by changing the blending proportion of tungsten and rubber. In this event, the specific gravity is set over multiple levels within a predetermined range (for example from 10 to 13) including a specific gravity equivalent to that of lead (approximately 11.3) such that a desired touch load can be ensured and the touch load can be smoothly adjusted.

According to the key 1 configured as described above, since tungsten and rubber are used as the material for the weight 4 instead of conventionally used lead, the weight 4 can be fabricated without harm at a low cost. Also, since the weight 4, with its elasticity, can be attached to the embedding hole 9 through simple press fitting, the attaching work can be facilitated as compared with the conventional caulked weight.

Also, the weight 4 is removably attached to the key body 2, and various types of weights 4*l*–4*n*, which are different in weight, have been provided, so that the touch load can be readily and appropriately adjusted for the key 1 by selecting one having an optimal weight from these weights 4 for attachment. For example, each key body 2 is formed with three embedding holes 9 of the same size at the same positions, and a weight 4 having a specific gravity equivalent to that of lead is attached thereto as a standard weight. In this state, the touch load is measured, and the weight 4 may be simply exchanged with another weight 4 having a proper weight in accordance with the result, thereby making it possible to readily provide a desired touch load. This results in complete elimination of the cutting of the weight for reducing the touch load, additional provision and positioning of the embedding hole and a weight for increasing the touch load in the prior art. As such laborious works are omitted, the manufacturing cost of the key 1 can be reduced correspondingly. In addition, since no additional embedding hole 9 is formed, it is possible to prevent the strength of the key body 2 from degrading.

Figure 4:
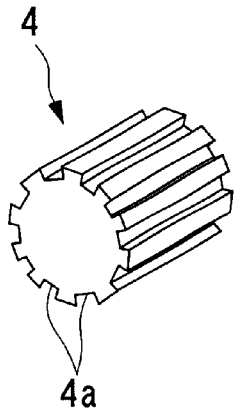
FIG. 4 is a perspective view illustrating a weight for a key according to an exemplary modification.

FIG. 4 illustrates an exemplary modification to the weight 4. This weight 4 is formed with a large number of elongated grooves 4*a* on the outer peripheral face of the aforementioned weight 4 in FIG. 3 in the longitudinal direction. According to this weight 4, since the formation of the elongated grooves 4*a* makes the weight 4 more susceptible to deformation than the weight 4 in FIG. 3, removal from and attachment to the embedding hole 9 is facilitated, so that the weight attaching work can be more readily carried out.

While in this embodiment, the elastic composite material comprising the weight 4 is produced by blending tungsten and rubber, suitable materials other than the above, but except for lead, may be employed as long as they can ensure a required specific gravity and elasticity. Also, while the embodiment adjusts the touch load by exchanging the weights 4 attached to the three embedding holes 9 as appropriate, the method of adjusting the touch load is not limited to this. For example, an embedding hole for adjustment may be separately provided, such that a weight attached to this embedding hole for adjustment is selected as appropriate for performing the adjustment.

Figure 5:
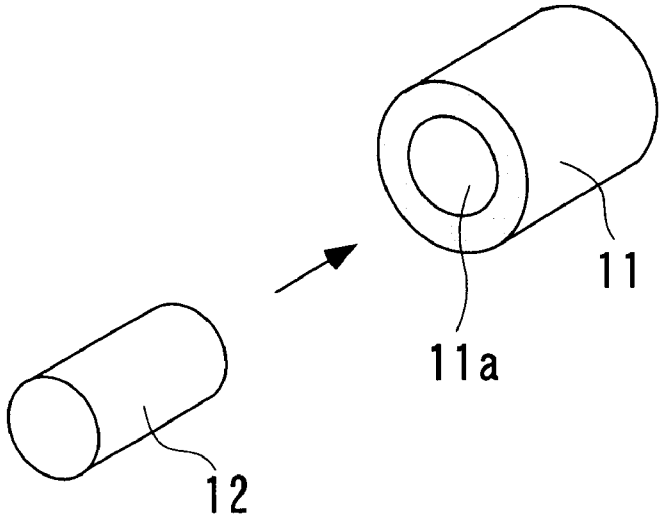
FIG. 5 is a perspective view illustrating a weight for a key and a weight attaching member according to a second embodiment of the present invention.
Figure 6:
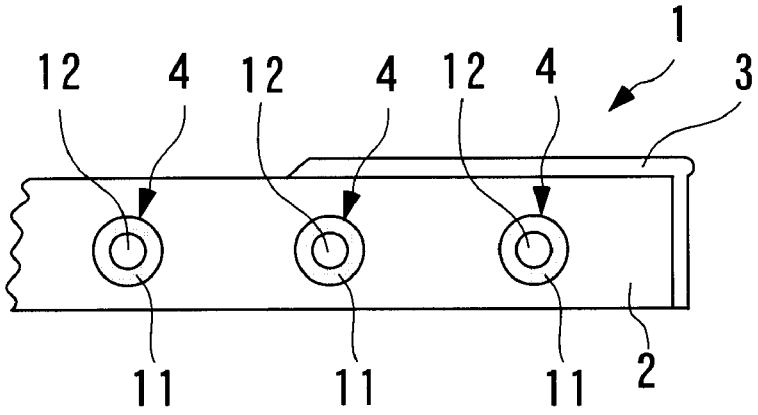
FIG. 6 is a partial enlarged side view illustrating a front region of a key which has the weight of FIG. 5 attached thereto.

FIGS. 5 and 6 illustrate a second embodiment of the present invention. As illustrated in both figures, in this embodiment, a weight 12 is attached to a key body 2 through a weight attaching member 11. The weight attaching member 11 is in the form of a sleeve with a predetermined diameter and length, having an inserting hole 11*a* of circular cross section, and is made of an elastic material such as rubber.

The weight 12, on the other hand, is in the form of a cylinder having the same length as the weight attaching member 11 and a diameter which allows the weight 12 to fit into the inserting hole 11*a*. Also, the weight 12 is comprised of a molding of a composite material made from a plurality of kinds of materials except for lead, for example, a blend of powered tungsten and plastic. The plastic in this case is used as a base resin for the weight 12, so that nylon is particularly preferred since it exhibits toughness, high impulse resistance, and good moldability. With the foregoing configuration, the weight 12, as removably fitted into the elastic weight attaching member 11, is removably fitted into the embedding hole 9 of the key body 2, taking advantage of the elasticity of the weight attaching member 11 which surrounds the outer periphery of the weight 12.

Also, various types of weights 12*l*–12*n* have been provided (see FIG. 24) as the weight 12.

These various types of weights 12*l*–12*n* have the size and shape identical to one another, and different predetermined specific gravities from one another by changing the blending proportion of tungsten and plastic, as is the case of the weight 4 in the first embodiment, so that they have different predetermined weights.

According to the key 1 configured as described above, the weight 12 can be made without using lead, and therefore without harm, and at a low cost, including the weight attaching member 11. Also, the weight 12 can be readily attached to the embedding hole 9 of the key body 2 through simple press fit by virtue of the elasticity of the weight attaching member 11, thus making it possible to provide completely similar effects to those of the first embodiment. Specifically, the simplification of the weight attaching work can reduce the manufacturing cost, as compared with the conventional one which involves the caulking. Further, since the weight 4 is removable from the key body 2, the touch load of the key 1 can be readily adjusted by selecting a weight having an optimal weight from various types of weights 12*l*–12*n* having different weights.

While in this embodiment, the weight 12 is made of a composite material produced by blending tungsten and plastic such as nylon, other appropriate materials except for lead may be employed as long as they can ensure a required specific gravity.

Figure 7A:
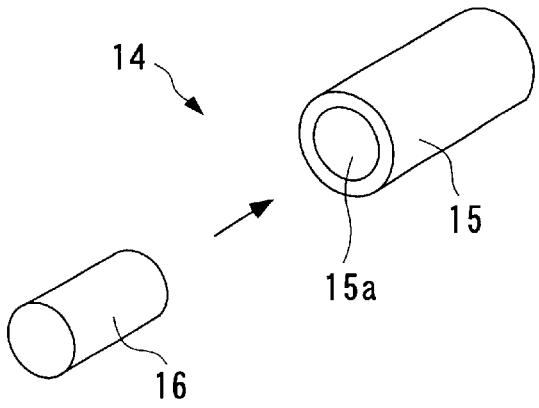
FIG. 7A is a perspective view of a weight for a key according to a third embodiment of the present invention before assembly.
Figure 7B:
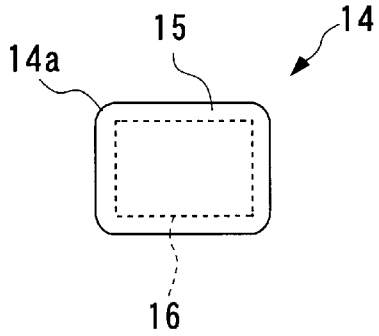
FIG. 7B is a front view of the weight of FIG. 7A after assembly.
Figure 8:
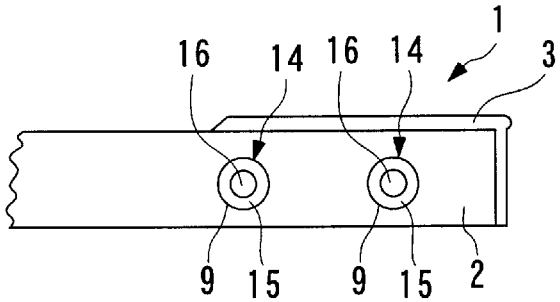
FIG. 8 is a partial enlarged view illustrating a front region of a key which has the weight of FIG. 7 attached thereto.

FIGS. 7A through 8 illustrate a third embodiment of the present invention. As illustrated in these drawings, in this embodiment, a weight 14 is comprised of a weight attaching member 15, and a weight body 16 accommodated in this weight attaching member 15, and is formed in a cylindrical shape as a whole.

The weight attaching member 15 is in the shape of a short sleeve of a predetermined diameter and length, which has an inserting hole 15*a* of circular cross section. The weight attaching member 15 in turn is made of a heat shrinkable plastic having elasticity such as ethylene propylene rubber, rubber fluoride, or the like, and exhibits the characteristics that it shrinks by heating and maintains the elasticity even after shrinkage.

The weight body 16, in turn, is in the shape of a cylinder having a length slightly shorter than the weight attaching member 15, and a diameter which allows the weight body 16 to be insertable into the inserting hole 15*a*. Also, the weight body 16 is made of a metal material having a relatively large specific gravity except for lead, for example, iron, stainless steel, copper, or the like. The weight body 16 is designed to have a weight equivalent to a conventional weight by sizing it slightly larger than a conventional weight made of lead. For example, iron has the specific gravity of approximately 7.9, and lead approximately 11.3, so that the weight 16 can ensure a weight equivalent to that of the conventional weight by setting the diameter of the weight body 16 to be approximately 1.2 times the conventional weight, and can be embedded sufficiently in the embedding hole 9 of the key body 2.

The weight 14 configured as described above is assembled by inserting the weight body 16 into the inserting hole 15*a* of the weight attaching member 15, and then heating the weight attaching member 15 for shrinkage, as illustrated in FIG. 7A. In this way, as illustrated in FIG. 7B, the weight attaching member 15 comes into close contact with the weight body 16 to cover the same. Also, since the weight attaching member 15 is slightly longer than the weight body 16 as mentioned above, chamfered corners 14*a* are formed on an end face of the weight 14 by the heat shrinkage of the weight attaching member 15.

Then, the weight 14 thus assembled is fitted into an embedding hole 9 of a key body 2 for attachment thereto. For fitting the weight 14, the chamfered corners 14*a* formed on the end face thereof permit smooth insertion of the weight into the embedding hole 9, and the elastic weight attaching member 15 shrinks into deformation, so that the weight 14 can be extremely readily attached. Also, after the attachment, the elastic return force of the weight attaching member 15 keeps the weight 14 in close contact with the embedding hole 9, thereby making it possible to prevent trembling of the weight 14 and noise caused thereby. Also, since the weight attaching member 15 is made of ethylene propylene rubber or the like, a noise reduction capability can be provided by absorbing sound within a certain frequency band by the weight attaching member 15 itself.

In the foregoing manner, according to the key 1 of this embodiment, the weight 14 can be comprised of the sleeve-shaped weight attaching member 15 made of heat shrinkable plastic having elasticity, and a weight body 16 made of a metal material having a high specific gravity such as iron and accommodated in the weight attaching member 15 in close contact therewith, without using lead and accordingly without harm, and at a low cost. Also, the elasticity of the weight attaching member 15 permits the weight 14 to be readily attached to the embedding hole 9 of the key body 2 through simple fitting, so that the weight attaching work can be simplified to reduce the manufacturing cost, as compared with the conventional caulked one.

While this embodiment employs ethylene propylene rubber and rubber fluoride as the heat shrinkable plastic, of which the weight attaching member 15 is made, and iron, stainless steel and copper as the metal material, of which the weight body 16 is made, these are merely illustrative, and other appropriate materials may be employed.

FIGS. 9A through 13A illustrate weights 24A–24E different from one another for a key according to a fourth embodiment of the present invention. The weight 24A illustrated in FIGS. 9A and 9B has a large number of hemispherical protrusions 25*b* (convex elements) formed in a staggered layout on the outer peripheral face of a body 25*a* which is in the shape of a short cylinder having a predetermined diameter and length. The weight 24A is made of a composite material produced by blending a metal except for lead, for example, powdered tungsten, and plastic, for example, nylon, and is molded, for example, by injection molding. Also, various types of weights 24A*l*–24A*n* (represented by the weight 24 in FIG. 24) having different weights from one another have been previously provided as the weight 24A. These various types of weights 24A have predetermined specific gravities different from one another, and hence different predetermined weights by changing the blending proportion of tungsten and nylon. The weight 24A of the foregoing configuration is attached to the key body 2 by press fit into each embedding hole 9, for example, caulking (implantation).

According to the foregoing configuration, the weight 24A can be made of harmless tungsten and nylon instead of conventionally used lead. Also, the large number of protrusions 25*b* formed on the outer peripheral face of the weight 24A can reduce the frictional resistance when the weight 24A is caulked into the embedding hole 9, thereby facilitating the caulking. In addition, since an impact at that time is reduced, the weight 24A is less susceptible to a failure or the like. Further, since the protrusions 25*b* ensure the caulking effect, the weight 24A can be securely attached to the key body 2.

Also, since various types of weights 24A*l*–24A*n* having different weights have been provided, a touch load of the key 1 can be readily and appropriately adjusted by selecting one having an optimal weight from them.

Figure 9A:
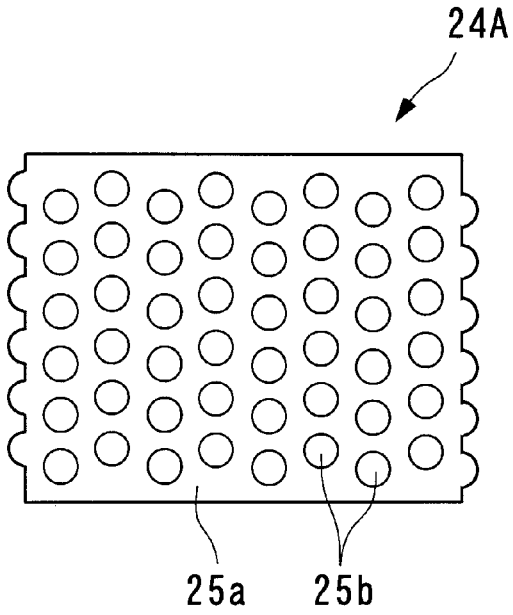
FIG. 9A is a plan view of a weight for a key according to a fourth embodiment of the present invention.
Figure 9B:
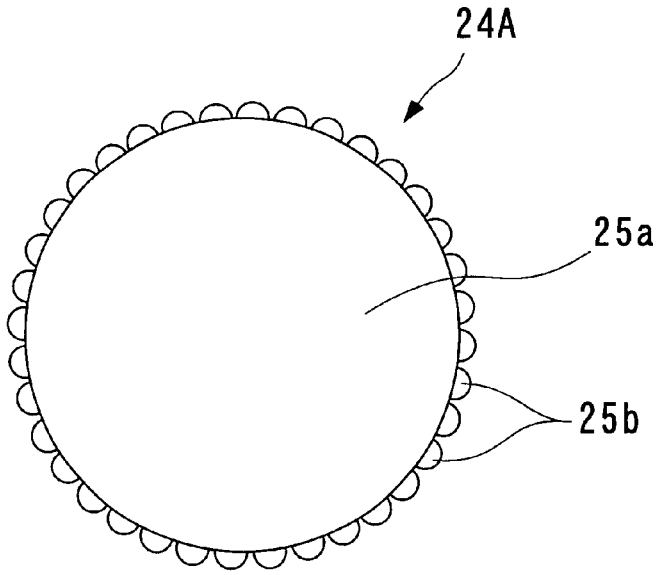
FIG. 9B is a side view of the weight of FIG. 9A.
Figure 10A:
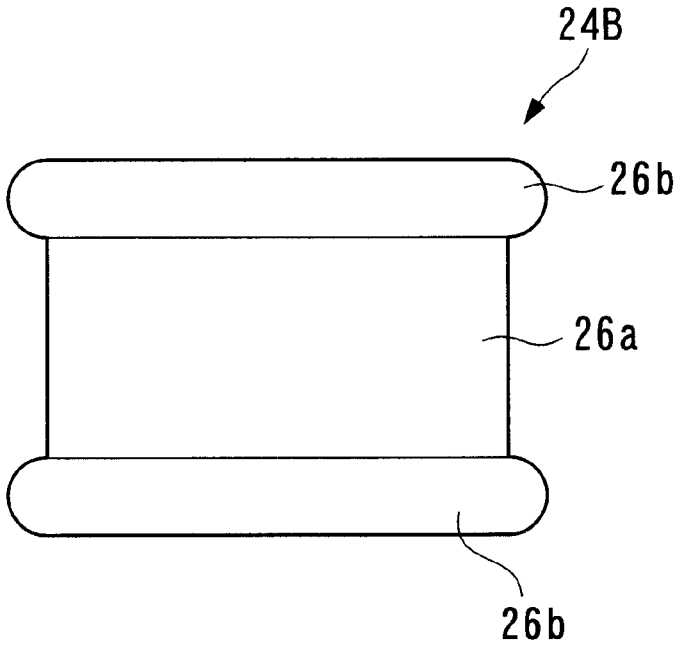
FIG. 10A is a plan view of a weight according to an exemplary modification to the fourth embodiment of the present invention.
Figure 10B:
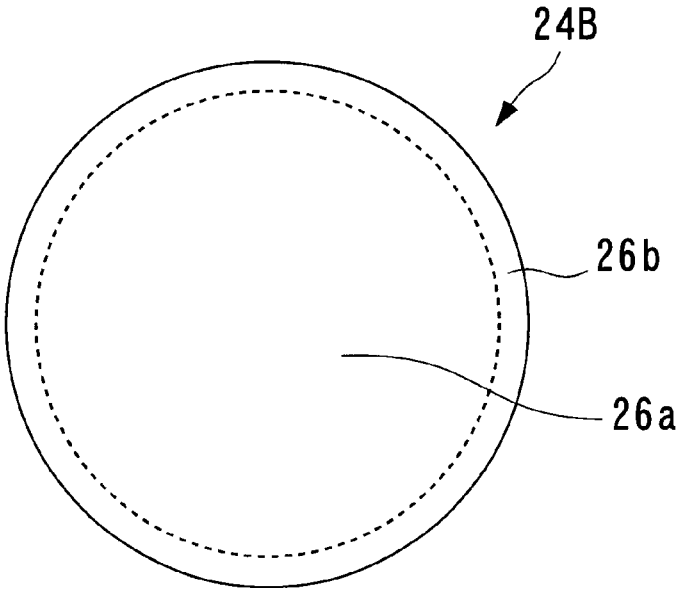
FIG. 10B is a side view of the weight of FIG. 10A.

A weight 24B illustrated in FIGS. 10A and 10B differs only in the shape, in comparison with the weight 24A of FIG. 9A. As illustrated in the figures, the weight 24B has two flanges 26*b*, which continuously extend in the circumferential direction, formed as protrusions integrally with both ends of the outer peripheral face of a body 26*a* which is in the shape of short cylinder. Each of the flanges 26*b* has its surface chamfered. The remaining configuration is identical to the weight 24A.

Therefore, according to the weight 24B, similar effects to those of the weight 24A can be provided. In addition, since the weight 24B is in particular formed with the flanges 26*b* on both ends of the outer peripheral face, the caulking effect can be sufficiently ensured, thereby permitting secure attachment of the weight 24B to the key body 2. Further, the chamfered flanges 26*b* permits smooth caulking and relieved stress concentration during the caulking, thereby making the weight 24B less susceptible to a failure and so on.

Figure 11A:
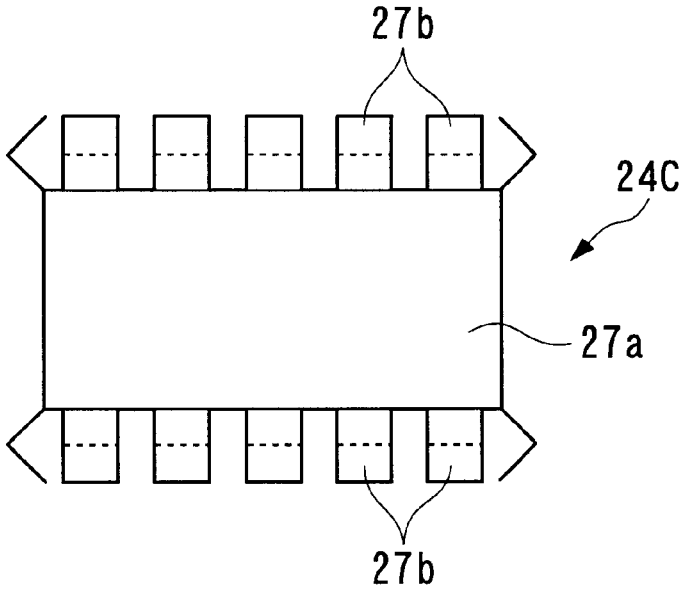
FIG. 11A is a plan view of a weight according to another exemplary modification to the fourth embodiment of the present invention.
Figure 11B:
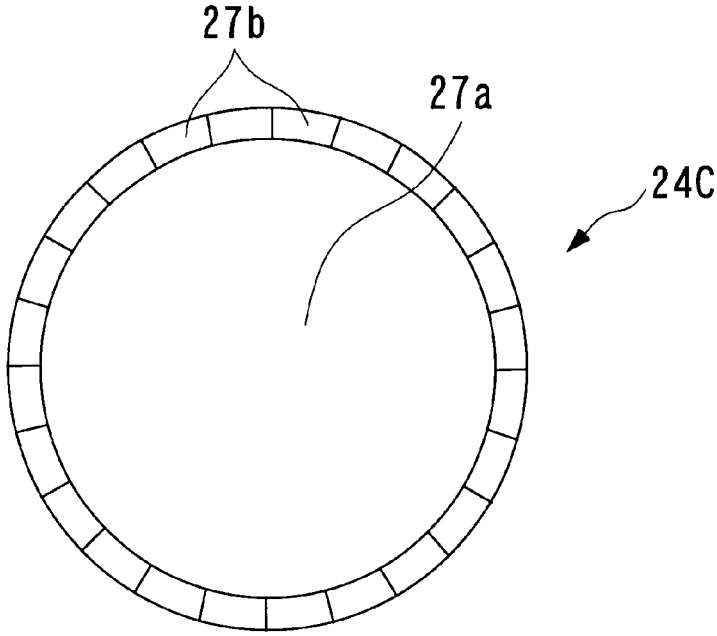
FIG. 11B is a side view of the weight of FIG. 11A.

A weight 24C illustrated in FIGS. 11A and 11B is also different only in the shape as compared with the weights 24A, 24B described above. As illustrated in the figures, the weight 24C has a large number of protrusive pieces 27*b* formed as convex elements integrally with both ends of the outer peripheral face of a body 27*a* which is in the shape of short cylinder. The protrusive pieces 27*b* are spaced apart from each other on both ends of the outer peripheral face of the body 27*a* in the circumferential direction. Also, each of the protrusive pieces 27*b* extends outward in the axial direction of the body 27*a*, and is bent to stick out in a radial direction. This configuration provides suitable elasticity. The remaining configuration is similar to the weights 24A, 24B.

Therefore, according to this weight 24C, similar effects to those of the weight 24A can be provided. In addition, since the weight 24C in particular takes advantage of the elasticity of the protrusive pieces 27*b* to snap fit into the embedding hole 9, the weight 24C can be readily and securely attached to the key body 2 without caulking.

Figure 12A:
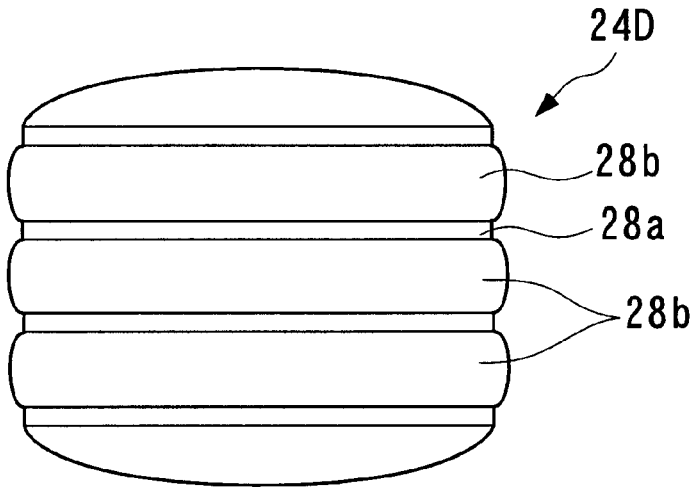
FIG. 12A is a plan view of a weight according to a further exemplary modification of the fourth embodiment of the present invention.
Figure 12B:
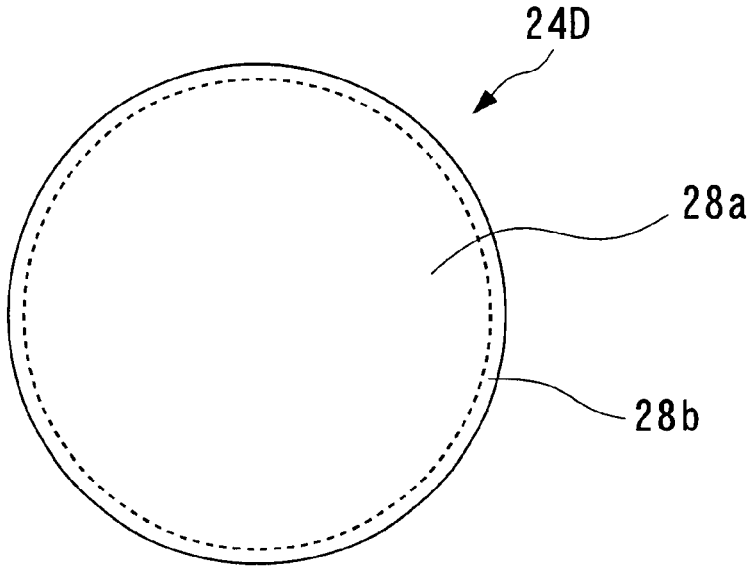
FIG. 12B is a side view of the weight of FIG. 12A.

A weight 24D illustrated in FIGS. 12A and 12B is likewise different only in the shape as compared with the weights 24A–24C described above. As illustrated in the figures, the weight 24D has three larger diameter portions 28*b* formed as convex elements integrally with a central region of the outer peripheral face of a body 28*a* which is in the shape of short cylinder. The three larger diameter portions 28*b* are arranged spaced apart from each other in the axial direction of the body 28*a*, and continuously extend in the circumferential direction. Also, the surface of each larger diameter portion 28*b* as well as both side faces of the body 28*a* are chamfered. The remaining configuration is similar to the weights 24A–24C.

Therefore, according to this weight 24D, similar effects to those of the weight 24A can be provided. In addition, since the weight 24D in particular is formed with a plurality of the larger diameter portions 28*b* in a central region of the outer peripheral face, the caulking effect can be enhanced as compared with the weight 24B of FIG. 10A which has the flanges 26*b* disposed on both ends. Further, in addition to this configuration, the chamfering of the larger diameter portions 28*b* and the side face of the body 28*a* permits smooth caulking, and makes the weight 24D less susceptible to a failure and so on which may be caused by an impact during the caulking.

Figure 13A:
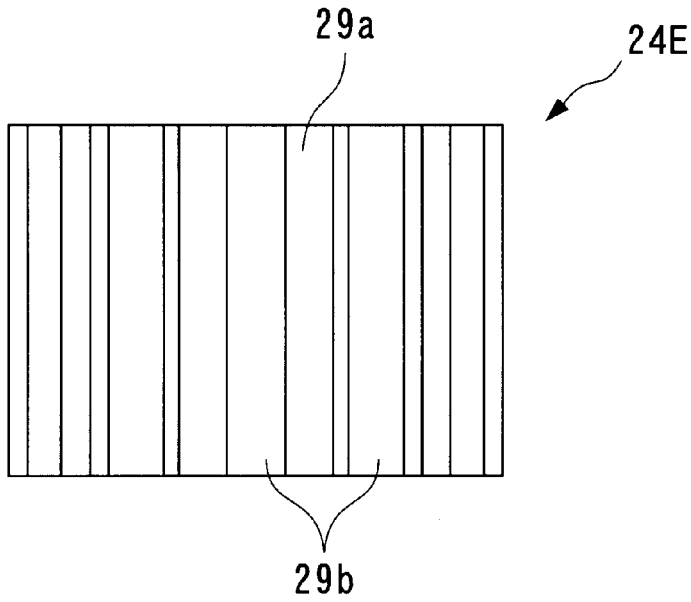
FIG. 13A is a plan view of a weight according to a further exemplary modification of the fourth embodiment of the present invention.
Figure 13B:
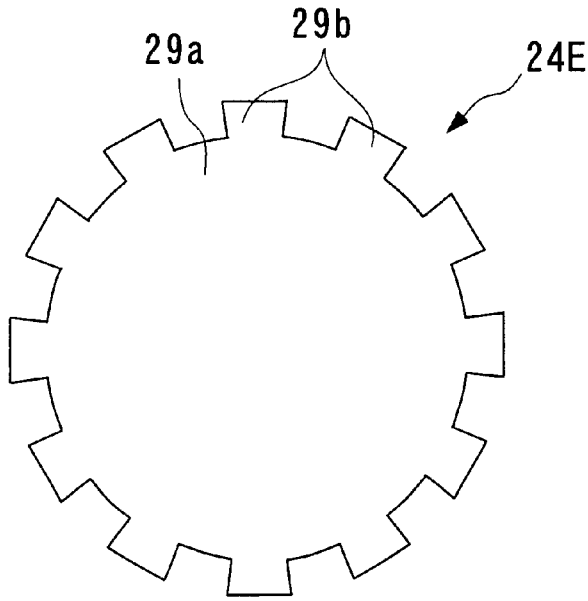
FIG. 13B is a side view of the weight of FIG. 13A.

A weight 24E illustrated in FIGS. 13A and 13B is likewise different only in the shape as compared with the weights 24A–24D described above. As illustrated in the figures, the weight 24E has a large number of convex bars 29*b* formed as convex elements formed integrally on the outer peripheral face of the body 29*a* which is in the shape of a short cylinder. These convex bars 29*b* are arranged spaced apart from each other on the outer peripheral face of the body 29*b* in the circumferential direction, and extend in the axial direction. The remaining configuration is similar to the weights 24A–24D.

Therefore, according to the weight 24E, similar effects to those of the weight 24A can be provided. In addition, since the weight 24E in particular is more prone to shrinkage or deformation because of a large number of the convex bars 29*b* formed in the circumferential direction and extending in the axial direction, the caulking is facilitated. In addition, since an impact at that time is reduced, the weight 24E is less susceptible to a failure.

As the material for the weights 24A–24E, a composite material of another heavy metal except for lead and plastic except for nylon may be employed instead of the aforementioned composite material of tungsten and nylon, as long as the resulting weights can ensure required weights.

Figure 14:
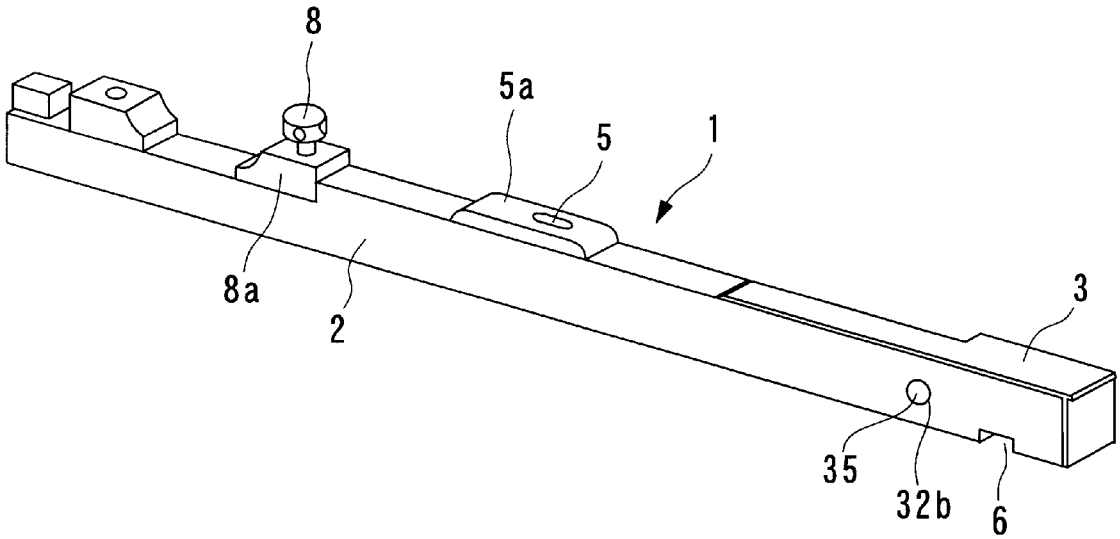
FIG. 14 is a perspective view illustrating a key for a grand piano according to a fifth embodiment of the present invention.
Figure 15:
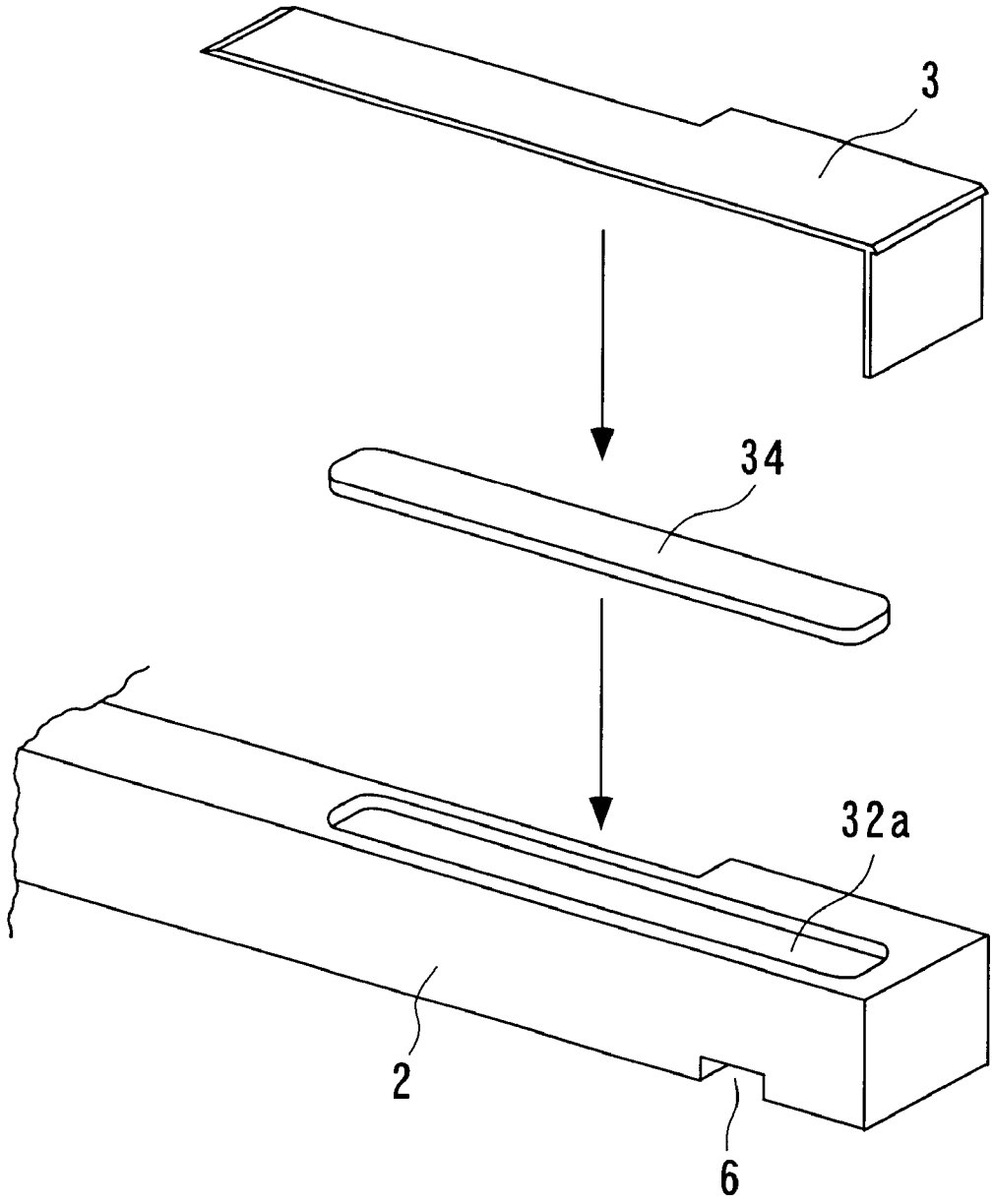
FIG. 15 is a partial enlarged perspective view of the key of FIG. 14.
Figure 16:
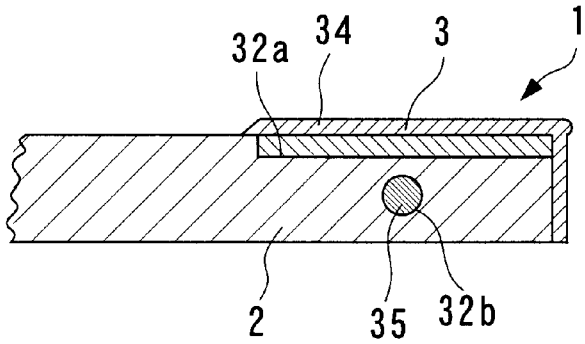
FIG. 16 is a partial cross-sectional view of the key.

FIGS. 14 through 16 illustrate a fifth embodiment of the present invention. As illustrated in these figures, in this embodiment, a weight 34 is formed in a plate shape, and disposed on the top face of a key body 2. As illustrated in FIG. 15, the key body 2 is formed with a recess 32*a* in a front region of the top face, extending along the key body 2. This recess 32*a* is relatively shallow, and formed in the shape of an elongated rectangle extending in the longitudinal direction except for a front end region of the key body 2, and is formed with four chamfered corners. A weight 34 is fitted into the recess 32*a*. A white key cover 3 is comprised of a molding of plastic such as acrylic, as before, which has an L-shaped cross section. The white key cover 3 is adhered on a front region of the top face and a front face of the key body 2 so as to cover the weight 34.

The weight 34, which is in the shape of plate, has a predetermined size and shape complementary to the recess 32*a* of the key body 2 so that the weight 34 is exactly fitted into the recess 32*a* flush with the key body 2. Also, the weight 34 is made of a composite material produced by blending a plurality of kinds of materials except for lead, for example, powdered tungsten and nylon, and is molded, for example, by injection molding. Further, the weight 34 is formed to have a predetermined large specific gravity equivalent or approximate to that of lead by blending tungsten and nylon in a predetermined blending proportion. In this way, the weight 34 has a predetermined weight such that the weight 34 can burden a majority of a weight which should be given to the key body 2. It goes without saying that as the material for the weight 34, a plurality of other kinds of materials except for lead, for example, a composite material of a heavy metal other than tungsten and plastic other than nylon may be employed as long as the resulting weights can ensure required weights.

In addition, a weight 35 for adjustment is used separately from the weight 34. This weight 35 for adjustment, which is in a cylindrical shape, is made of a molding of the same composite material having the same specific gravity as the weight 34, and has a predetermined size and weight. The weight 35 for adjustment is fitted into one of embedding holes 32*b* (see FIG. 14) formed at positions, later described, on a side face of the key body 2 for attachment thereto. Though not shown, the weight 35 for adjustment is formed on the outer peripheral face thereof with ruggedness for facilitating the fitting into the embedding hole 32*b*.

The key 1 in the foregoing configuration is assembled, for example, in the following manner, while adjusting a touch load. First, as illustrated in FIG. 15, the weight 34 is fitted into the recess 32*a* of the key body 2 from above to be flush with the key body 2. Subsequently, the white key cover 3 is adhered to cover the weight 34, and the touch load is measured. Next, based on the measured touch load, an attaching position is determined so as to provide a desired touch load, an embedded hole 32*b* is formed at this attaching position, and the weight 35 for adjustment is fitted into the embedding hole 32*b* in accordance with a shortage of the load. In the foregoing manner, the desired touch load is provided, together with the completion of the assembly of the key 1 (see FIG. 16).

As described above, according to the key 1 of this embodiment, the weight 34 and the weight 35 for adjustment can be made using harmless tungsten and nylon instead of conventionally used lead. Also, since the weight 34 is fitted into the recess 32*a* of the key body 2 from above for attachment, this eliminates a work for forming an embedding hole for attaching the weight 34, and a work for caulking the weight. Further, the weight 34 can be exactly fitted into the recess 32*a* and therefore attached to the key body 2 without trembling. In addition, since the weight 34 is covered with the white key cover 3, the outer appearance of the key 1 will not be affected at all. While in this embodiment, the weight 34 is sized and shaped to be complementary to the recess 32*a* of the key body 2 such that it is exactly fitted into the recess 32*a*, the shape and so on of the weight 34 are arbitrary as long as the weight 34 can be accommodated in the recess 32*a* without trembling in combination of an adhesive or the like.

Also, the touch load can be readily adjusted by attaching the single weight 35 for adjustment to the key body 2 while determining a position at which it should be attached. In this event, since the weight 34 is disposed only near the top face of the key body 2 and does not exist in a lower portion, the weight 35 for adjustment can be attached at a determined desired attaching position, without being interfered by an existing weight, as opposed to the prior art. As a result, the touch load can be efficiently adjusted without changing the weight or attaching position of the weight 35 for adjustment. Further, since only one embedding hole 32*b* need be formed, a degraded strength of the key body 2, caused by the formation of the embedding hole 32*b*, can be limited to a minimum.

Figure 17:
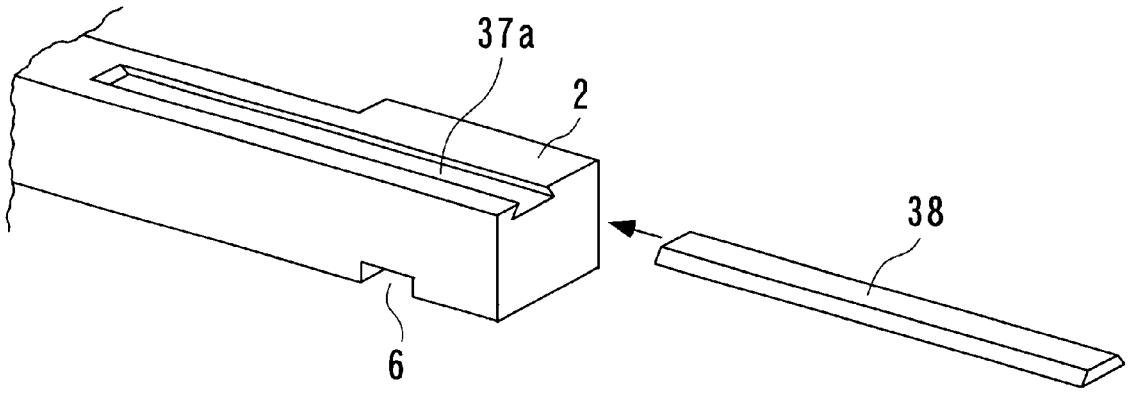
FIG. 17 is an exploded perspective view illustrating an exemplary modification to a plate-shaped weight.

FIG. 17 illustrates an exemplary modification to the plate-shaped weight. In this exemplary modification, a recess 37*a* of the key body 2, and a plate-shaped weight 38 are both formed in trapezoid in cross section, and the recess 37*a* is open to the front face of the key body 2 such that the weight 38 is inserted into the recess 37*a* from the front and fitted therein in a so-called dovetail joint. It is therefore possible to securely attach the weight 38 to the recess 37*a* without trembling, preventing the weight 38 from coming off the recess 37*a* upwardly.

Figure 18:
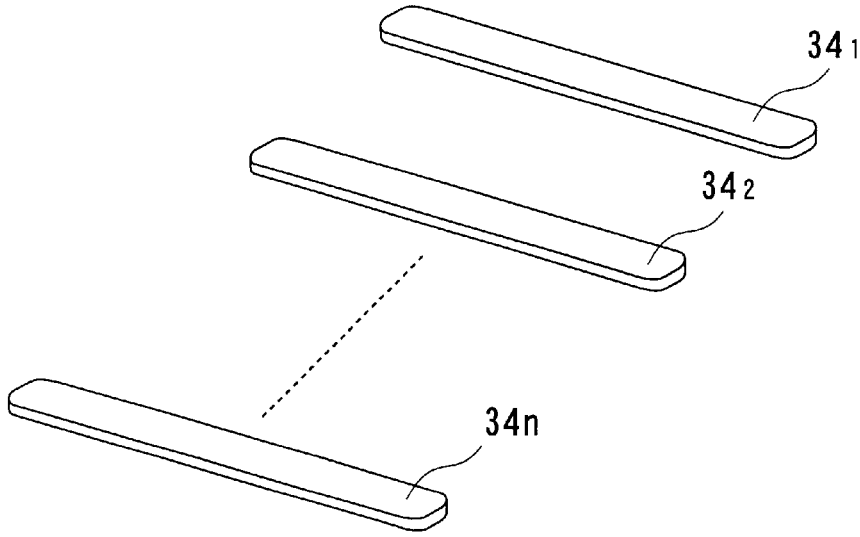
FIG. 18 is a perspective view illustrating various types of plate-shaped weights having different weights from one another.
Figure 19:
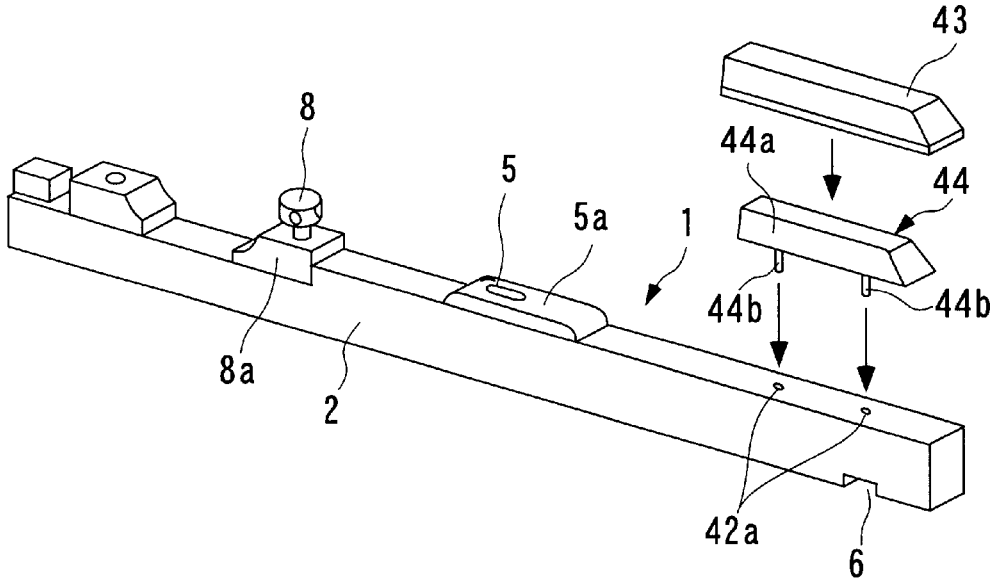
FIG. 19 is an exploded perspective view illustrating a black key for a grand piano according to a sixth embodiment of the present invention.
Figure 20:
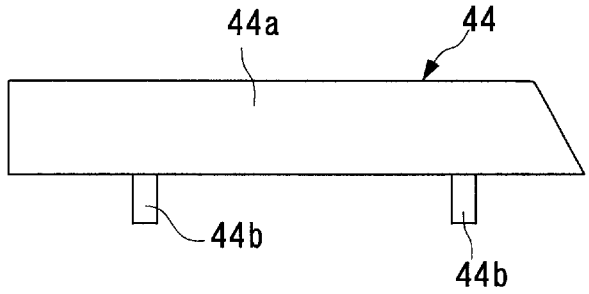
FIG. 20 is a side view illustrating the weight of the key of FIG. 19.

FIG. 18 illustrates another exemplary modification to the plate-shaped weight. In this exemplary modification, a plate-shaped weight 34 is comprised of various types of weights 34*l*–34*n* which are different in weight from one another. These weights 34*l*–34*n* have predetermined specific gravities different from one another by varying the blending proportion of tungsten and nylon, of which they are made, and have the size and shape identical to one another. Therefore, the touch load can be readily adjusted by selecting an appropriate weight 34 from them. With this expedient, the weight 35 for adjustment can be eliminated.

Alternatively, in a manner reverse to the various types of weights 34*l*–34*n*, a weight 44 may be made to have a different weight by changing the size, for example, the length or the height, while maintaining the same specific gravity of the composite material, of which the weight 44 is made.

Figure 21:
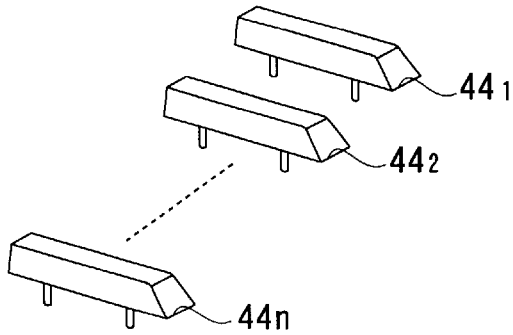
FIG. 21 is a perspective view illustrating various types of weights in FIG. 20 having different weights from one another.
Figure 22:
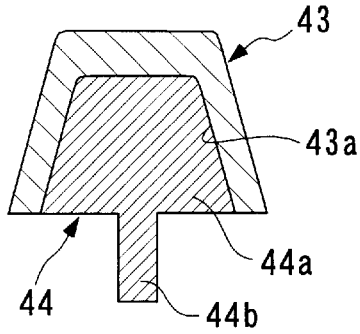
FIG. 22 is a cross-sectional view of a sharp key cover which has a weight attached thereto.

FIGS. 19 through 22 illustrate a sixth embodiment of the present invention. In this embodiment, the present invention is applied to a black key. This key (black key) 1 is comprised of a sharp key cover 43 attached to a front region of a key body 2, a weight 44 accommodated in the sharp key cover 43, and so on. Two positioning holes 42*a* one after the other are formed at predetermined positions in a front region of the top face of the key body 2 for positioning the sharp key cover 43 and the weight 44. The sharp key cover 43 is comprised of a molding made of plastic such as phenol, as before, and has a cavity 43*a* of a trapezoidal shape in cross section which is a hollow space open to below, as illustrated in FIG. 22.

Figure 23A:
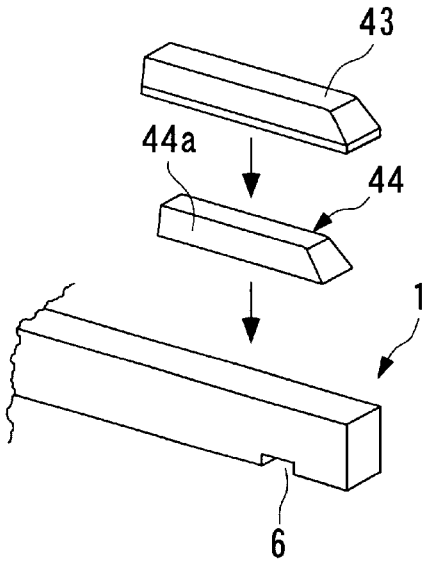
FIG. 23A is an exploded perspective view, similar to FIG. 19, when a weight does not have a positioning pin.
Figure 23B:
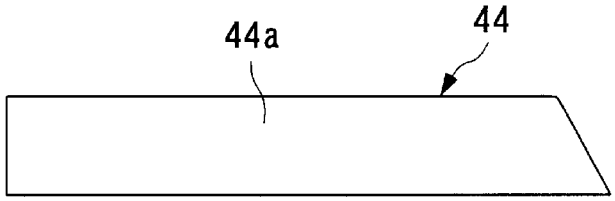
FIG. 23B is a side view of the weight of FIG. 23A.
Figure 23C:
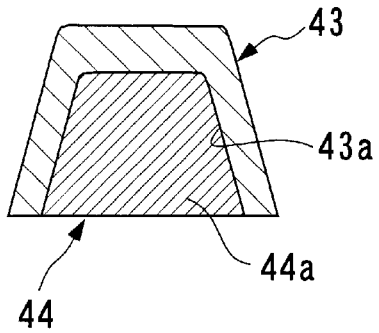
FIG. 23C is a cross-sectional view of a sharp key cover which has the weight of FIG. 23A attached thereto.

The weight 44 is comprised of a body 44*a*, and two positioning pins 44*b* which protrude downward from the body 44*a*. Also, as illustrated in FIGS. 23A through 23C, such positioning pins 44*b* may be omitted from the weight 44. As illustrated in FIG. 22, the body 44*a* has a size and shape complementary to the cavity 43*a* of the sharp key cover 43 such that the body 44*a* is exactly fitted into the cavity 43*a*. Also, the weight 44 is made of a composite material produced by blending a plurality of kinds of materials except for lead, for example, powdered tungsten and nylon, and is molded, for example, by injection molding. Of course, a composite material of a plurality of other kinds of materials except for lead, for example, a heavy metal other than tungsten and a plastic other than nylon, may be employed as the material for the weight 44 as long as it can ensure a required specific gravity.

Also, as illustrated in FIG. 21, various types of weights 44*l*–44*n*, different in weight from one another, have been previously provided as the weight 44. These various types of weights 44*l*–44*n* have predetermined specific gravities different from one another by varying the blending proportion of tungsten and nylon, and therefore have the size and shape identical to one another and predetermined weights different from one another.

The weight 44 in the foregoing configuration is attached to the sharp key cover 43, while adjusting a touch load, for example, in the following manner. Specifically, a weight 44 having a specific gravity equivalent to that of lead is fitted into the cavity 43*a* of the sharp key cover 43 as a standard weight, and the respective positioning pins 44*b* are engaged with the positioning holes 42*a* of the key body 2. In this sate, the touch load is measured. If the measured touch load is different from a desired value, another weight 44 having a proper weight is selected from the various types of weights 44*l*–44*n* for replacement with the previously attached weight 44 in accordance with the result. Then, the selected weight is fitted into the cavity 43*a* of the sharp key cover 43, and the touch load is again measured in a manner similar to the foregoing. When it is confirmed that the desired touch load is achieved, the weight 44 is once removed from the sharp key cover 43, and again fitted into the recess 43*a*, after an adhesive is applied thereto, with the lower face flush with that of the sharp key cover 43, and adhered to the sharp key cover 43 (see FIG. 22). Further, an adhesive is applied to lower faces of the sharp key cover 43 and the weight 44, and the respective positioning pins 44*b* are engaged with the positioning holes 42*a* for positioning. Then, in this state, the sharp key cover 43 and the weight 44 are adhered on the top face of the key body 2, thus completing the attachment.

With a weight 44 excluding the positioning pins 44*b*, illustrated in FIGS. 23A through 23C, after a weight 44 to be attached is determined, the sharp key cover 43 and the weight 44 are applied with an adhesive on their lower faces, and are adhered on the top face of the key body 2, while visually positioning them, to complete the attachment in a manner similar to the above.

According to the key 1 in the foregoing configuration, the weight 44 can be made using harmless tungsten and nylon instead of conventionally used lead. In addition, the cavity 43*a*, generally formed in the sharp key cover 43, is utilized to fit the weight 44 thereinto, so that conventional works for forming embedding holes and caulking the weights are eliminated, thereby making it possible to reduce the manufacturing cost by a reduction in the number of steps for these works.

Also, the touch load of the key 1 can be readily and appropriately adjusted by selecting one having an optimal weight from the various types of weights 44*l*–44*n*. As a result, the manufacturing cost of the key 1 can be further reduced by the elimination of the conventional laborious works for adjusting the touch load. Further, unlike the prior art, since the key body 2 is not at all formed with embedding holes, the strength of the key body 2 can be sufficiently maintained.

In this embodiment, the various types of weights 44 are given different weights by varying the specific gravity of the composite material, of which they are made, while maintaining the same size and shape. Alternatively, the various types of weights 44 may be given different weights by varying the size, for example, the length and the height of the weights 44, while maintaining the same specific gravity of the composite material. Further, while in this embodiment, the weight is comprised only of the weight 44 fitted into the sharp key cover 43, two types of weights may be used in combination, such as, for example, one of pin-shaped weights made of the same material as the weight 44 which is attached to an embedding hole formed in the key body 2, and a weight 44 having the remaining portion of the weight which is fitted into the sharp key cover 43. Further, in this embodiment, the weight 44 is made in the size and shape complementary to the cavity 43*a* of the black cover 43 such that it is exactly fitted into the cavity 43*a*. Nevertheless, the shape and so on of the weight 44 is arbitrary as long as it can be accommodated in the cavity 43*a* in combination of an adhesive or the like without trembling.

The present invention is not limited to the embodiments so far described, but may be implemented in a variety of manners. For example, while the foregoing embodiments have shown examples of keys for a grand piano, the present invention can be applied to any key having a weight attached thereto, such as keys for an upright piano, an electronic piano, a keyboard musical instrument toy, and so on.

Those skilled in the art will understand that the foregoing is the description of the preferred embodiments of the present invention, and a variety of modifications may be made without departing from the spirit and scope of the present invention.

What is claimed is:

1. A key comprising:

a swingable key body formed with an embedding hole; and a weight made of a composite material produced by blending a plurality of kinds of materials except for lead in a predetermined blending proportion so as to have a predetermined specific gravity, said weight being removably attached to said embedding hole of said key body, wherein one of said plurality of kinds of materials comprises an elastic material, so that said weight has elasticity, and is removably attached to said embedding hole of said key body through press fitting wherein said elastic material comprises rubber, and another one of said plurality of kinds of materials comprises powdered tungsten.

2. A key according to claim 2, wherein said weight comprises a plurality of types of weights made by blending said elastic material and said other one of said plurality of kinds of material in different blending proportions from one another to have different specific gravities from one another.

3. A key according to claim 2, wherein said key body comprises a plurality of key bodies which are formed with said embedding holes of a shape and size identical to one another, respectively, wherein said plurality of types of weights have the shape and size identical to one another, permitting said weights to be removably press fitted into said embedding holes.

4. A key comprising:

a swingable key body formed with an embedding hole;

a weight made of a composite material produced by blending a plurality of kinds of materials except for lead in a predetermined blending proportion so as to have a predetermined specific gravity, said weight being removably attached to said embedding hole of said key body; and a weight attaching member made of an elastic material in the shape of a sleeve having an inserting hole, wherein said weight is fitted into said inserting hole of said weight attaching member, and removably fitted into said embedding hole of said key body through said weight attaching member.

5. A key according to claim 4, wherein said plurality of kinds of materials include powdered tungsten and plastic, and said elastic material comprises rubber.

6. A key according to claim 4 or 5, wherein said weight comprises a plurality of types of weights which are made of a composite material produced by blending said plurality of kinds of materials except for lead in different blending proportions from one another so as to have different specific gravities from one another, and have a size and a shape identical to one another.

7. A key comprising:

a swingable key body formed with an embedding hole; and a weight fitted in said embedding hole of said key body, wherein said weight has a weight attaching member made of heat shrinkable plastic in the shape of a sleeve having a predetermined size, and a weight body made of a predetermined metal material except for lead in the shape of a cylinder having a predetermined size, accommodated in said thermally shrunk weight attaching member in close contact therewith.

8. A key according to claim 7, wherein said heat shrinkable plastic has elasticity.

9. A key comprising:

a swingable key body formed with an embedding hole; and a weight made of a molded composite material produced by blending a metal except for lead and plastic in a predetermined blending proportion to have a predetermined specific gravity, and embedded in said embedding hole to be attached to said key body, wherein said embedding hole is formed in a circular hole, and said weight is formed in the shape of a cylinder which is adapted to be press fitted into said embedding hole, and has a convex element on the outer peripheral face thereof to reduce a frictional resistance when said weight is press fitted into said embedding hole.

10. A key according to claim 9, wherein said metal except for lead comprises powdered tungsten, and said plastic comprises nylon.

11. A key according to claim 9, wherein said weight comprises a plurality of types of weights made of a plurality of kinds of composite materials having different specific gravities from one another, produced by blending said metal except for lead and said plastic in different blending proportions from one another.

12. A key according to claim 9, wherein said convex element comprises a plurality of protrusions formed on the outer peripheral face of said weight and spaced apart from one another.

13. A key according to claim 9, wherein said convex element comprises two flanges formed on both ends of the outer peripheral face of said weight along a circumferential direction.

14. A key according to claim 9, wherein said convex element comprises a plurality of elastic protrusive pieces arranged on both ends of the outer peripheral face of said weight and spaced apart from each other in a circumferential direction, said elastic protrusive pieces extending outward in the axial direction, and being stuck out in a radial direction.

15. A key according to claim 9, wherein said convex element comprises a plurality of circumferentially extending larger diameter portions arranged at positions except for both ends of the outer peripheral face of said weight, and spaced apart in the axial direction.

16. A key according to claim 9, wherein convex element comprises a large number of axially extending convex bars arranged on the outer peripheral face of said weight, and spaced apart in the circumferential direction.

17. A key comprising:

a swingable key body having a rectangular cross section, extending in the longitudinal direction, and formed with a recess in a front region of the top face thereof and along the same;

a plate-shaped weight made of a composite material produced by blending a plurality of kinds of materials except for lead having different specific gravities from one another, accommodated in said recess of said key body to impart a weight to said key body; and a key cover attached on the front region of said key body so as to cover said weight.

18. A key according to claim 17, wherein said key body is formed with an embedding hole on a side face of said key body at a longitudinal position determined in accordance with a touch load given by said weight, wherein said key further comprises a weight for adjustment made of a material except for lead, having a predetermined weight, and embedded in said embedding hole for adjusting the touch load.

19. A key according to claim 17, wherein said weight comprises a plurality of weights having different weights from one another.

20. A key according to claim 19, said plurality of types of weights are respectively made of composite materials having different specific gravities from one another, produced by blending said plurality of kinds of materials in different blending proportions from one another, and have a size and a shape identical to one another complementary to said recess of said key body.

21. A key comprising:

a swingable key body;

a sharp key cover having a cavity open to below, and attached on the top face of said key body; and a weight made of a composite material produced by blending a plurality of kinds of materials except for lead having different specific gravities from one another, and accommodated in said cavity of said sharp key cover to impart a weight to said key body.

22. A key according to claim 21, wherein said weight is molded into a predetermined size and shape corresponding to said cavity of said sharp key cover, and fitted in said cavity.

23. A key according to claim 21 or 22, wherein said weight comprises a plurality of types of weights having different weights from one another.

24. A key according to claim 23, wherein said plurality of types of weights have different sizes from one another.

25. A key according to claim 23, said plurality of types of weights are respectively made of composite materials having different specific gravities from one another, produced by blending said plurality of kinds of materials in different blending proportions from one another.

* * * * *